US005381320A

United States Patent [19]

Jordan

[11] Patent Number: 5,381,320

[45] Date of Patent: Jan. 10, 1995

[54] LIGHT FIXTURE

[75] Inventor: Randy L. Jordan, Bethalto, Ill.

[73] Assignee: International Lighting Manufacturing Company, St. Louis, Mo.

[21] Appl. No.: 7,520

[22] Filed: Jan. 22, 1993

[51] Int. Cl.[6] ..... F21V 17/00

[52] U.S. Cl. ..... 362/147; 362/223; 362/433

[58] Field of Search ..... 362/223, 207, 222, 260, 362/311, 433, 147, 388

[56] References Cited

U.S. PATENT DOCUMENTS

| | | | |
|---|---|---|---|
| 1,997,687 | 4/1935 | Hoegger | 240/6 |
| 2,070,973 | 2/1937 | Marsh | 240/73 |
| 2,281,376 | 4/1942 | Ohm | 362/223 |
| 2,281,379 | 4/1942 | Ohm | 362/223 |
| 2,825,798 | 3/1958 | Zingone | 362/223 |
| 2,993,115 | 7/1961 | Rosenblatt | 240/51.11 |
| 3,014,126 | 12/1961 | Endelson | 240/73 |
| 3,142,445 | 7/1964 | Jones | 240/73 |
| 3,712,978 | 1/1973 | Lowell | 240/1.3 |
| 3,794,830 | 2/1974 | Hitzler | 240/147 |
| 4,045,665 | 8/1977 | Williams et al. | 240/51.11 |
| 4,053,762 | 10/1977 | Barbson | 362/223 |
| 4,246,629 | 1/1981 | Marrero | 362/147 |
| 4,323,954 | 4/1982 | Florence et al. | 362/223 |
| 4,338,653 | 7/1982 | Marrero | 362/223 |
| 4,580,200 | 4/1986 | Hess et al. | 362/223 |
| 4,598,344 | 7/1986 | Nadler | 362/220 |
| 4,748,548 | 5/1988 | Barton | 362/249 |

FOREIGN PATENT DOCUMENTS 377938 7/1964 Switzerland .

*Primary Examiner*—Richard R. Cole

*Attorney, Agent, or Firm*—Senniger, Powers, Leavitt & Roedel

[57] ABSTRACT

A light fixture includes a housing having a top wall and a front wall. An upright lip on the housing projects up above the top wall generally adjacent the front wall. Fasteners mount at least one lamp on the housing forward of the front wall. A light diffuser is further provided including a hollow shell having a back with an opening therein to permit entry of the lamp and the housing lip into the shell as the diffuser is installed on the housing. When the diffuser is installed on the housing, the lip extends up on the inside of the shell closely adjacent an interior surface of the shell above the opening. The lip and interior surface of the shell are engagable to hold the diffuser on the housing, without the need for mechanical fasteners, in a position in which the diffuser shell is suspended on the housing with the back of the diffuser shell in close, generally abutting relation with the front wall of the housing.

21 Claims, 4 Drawing Sheets

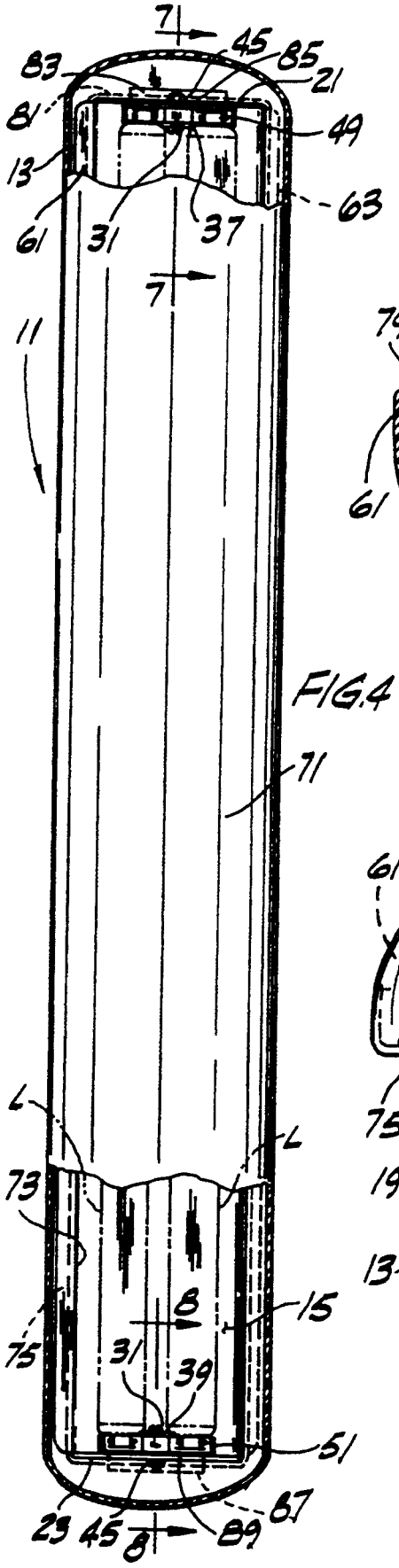
FIG.4
FIG.5
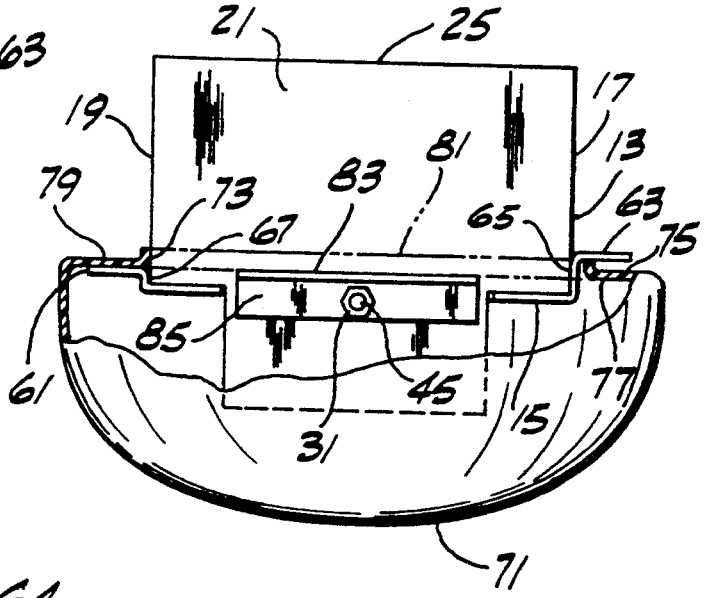
FIG.6
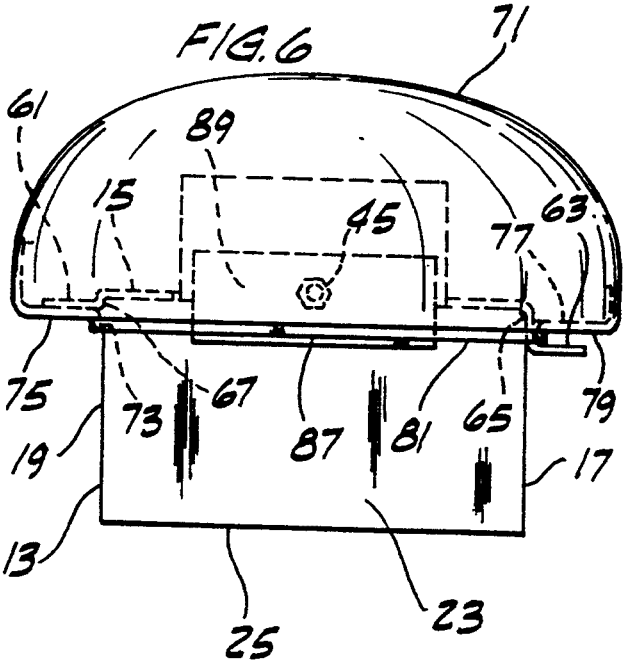

LIGHT FIXTURE

BRIEF SUMMARY OF THE INVENTION

This invention relates generally to light fixtures and more particularly to a light fixture having a housing designed to support a diffuser thereon without the need for mechanical fasteners.

FIG. 9 illustrates an example of a prior art light fixture capable of being mounted on a vertical wall in either a horizontal position or a vertical position. The prior art fixture includes a housing for supporting fluorescent lamps and a diffuser enclosing the fluorescent lamps mounted on the front wall of the housing. Screw fasteners located at opposite ends of the diffuser secure the diffuser to the housing. To remove the diffuser and replace a burned-out lamp, a person must use a tool, such as a screw driver, to unscrew the screw fasteners. Upon replacing the burned-out lamp, the diffuser is then positioned back on the housing and held in place until the screw fasteners are reinserted and tightened. This process is both time-consuming and cumbersome.

Accordingly, among the several objects of the present invention is that of an improved light fixture with a housing designed to support a diffuser without the need for mechanical fasteners; the provision of such a light fixture which is capable of being selectively mounted in either a horizontal position or a vertical position on a wall; the provision of such a light fixture in which lamps mounted on the housing and enclosed by the diffuser are easily accessible by removing the diffuser by hand without the need of tools; and the provision of such a light fixture which is simple in design and construction, and easy to use.

Generally, a light fixture of the present invention comprises a housing having a top wall and a front wall. An upright lip on the housing projects up above the top wall of the housing generally adjacent the front wall of the housing. Means mounts at least one lamp on the housing forward of the front wall of the housing. Also provided is a light diffuser comprising a hollow shell having a back with an opening therein to permit entry of said lamp and said lip into the shell as the diffuser is installed on the housing. The lip on the housing is adapted to extend up on the inside of the shell closely adjacent an interior surface of the shell above said opening when the diffuser is installed on the housing. The lip and interior surface of the shell are engagable to hold the diffuser on the housing, without the need for mechanical fasteners, in a position in which the diffuser shell is suspended on the housing with the back of the diffuser shell in close, generally abutting relation with the front wall of the housing.

In another aspect of the invention, an elongate light fixture capable of being selectively mounted on a wall in either a vertical position or a horizontal position comprises a generally rectangular housing having a front wall. Means mounts at least one lamp on the housing forward of the front wall of the housing. Also provided is a light diffuser comprising a hollow shell having a back with an opening therein for entry of said lamp into the shell as the diffuser is installed on the housing. A first lip projects up above the housing adjacent the front wall of the housing when the fixture is mounted in said generally horizontal position. The first lip is adapted to extend up on the inside of the diffuser shell closely adjacent an interior surface of the shell above said opening when the diffuser is installed on the housing and the fixture is mounted in a generally horizontal position. The first lip and interior surface of the shell are engagable to hold the diffuser on the housing, without the need for mechanical fasteners, in a position in which the diffuser shell is suspended on the housing with the back of the diffuser shell in close, generally abutting relation with the front wall of the housing. A second lip projects up above the housing adjacent the front wall of the housing when said fixture is mounted in a generally vertical position. The second lip is adapted to extend up on the inside of the diffuser shell closely adjacent an interior surface of the shell above said diffuser opening when the diffuser is installed on the housing and the fixture is mounted in a generally vertical position. The second lip and interior surface of the shell are engagable to hold the diffuser on the housing, without the need for mechanical fasteners, in a position in which the diffuser shell is suspended on the housing with the back of the diffuser shell in close, generally abutting relation with the front wall of the housing.

Other objects and features will be in part apparent and in part pointed out hereinafter.

BRIEF DESCRIPTION OF THE DRAWINGS

FIG. 4 is a front view of the light fixture as mounted vertically on the wall, portions of the diffuser being broken away;

FIG. 5 is an enlarged top view of the light fixture shown in FIG. 4 with portions of the diffuser broken away;

FIG. 6 is an enlarged bottom view of the light fixture shown in FIG. 4;

Corresponding reference characters indicate corresponding parts throughout the several views of the drawings.

DETAILED DESCRIPTION OF THE PREFERRED EMBODIMENT

Figure 1:
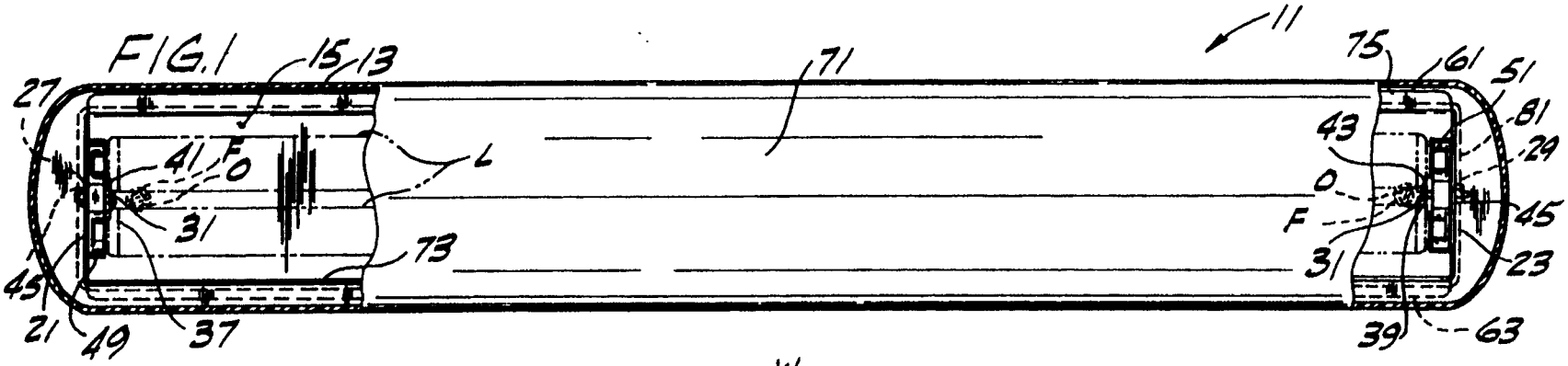
FIG. 1 is a front view of a light fixture of the present invention mounted horizontally on a wall, portions of the fixture being removed to illustrate details.
Figure 3:
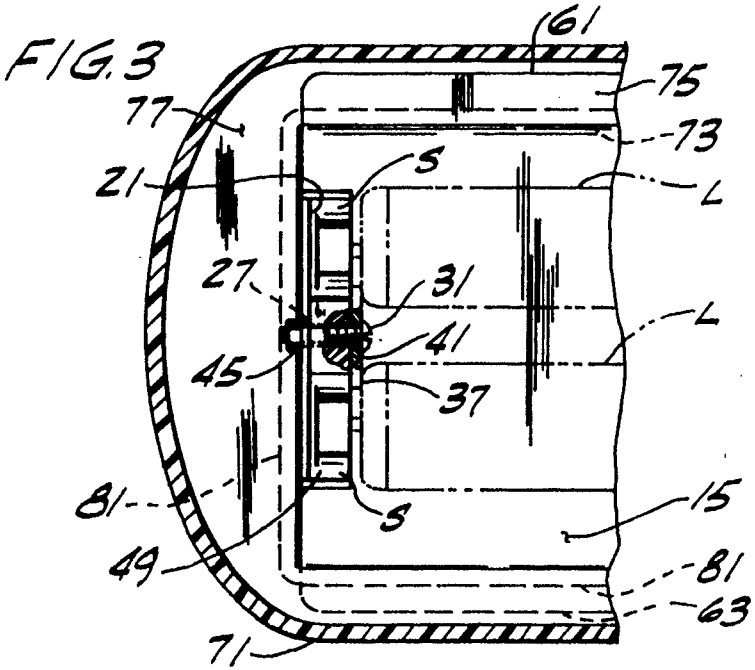
FIG. 3 is an enlarged front view of portions of the light fixture shown in FIG. 1.
Figure 2:
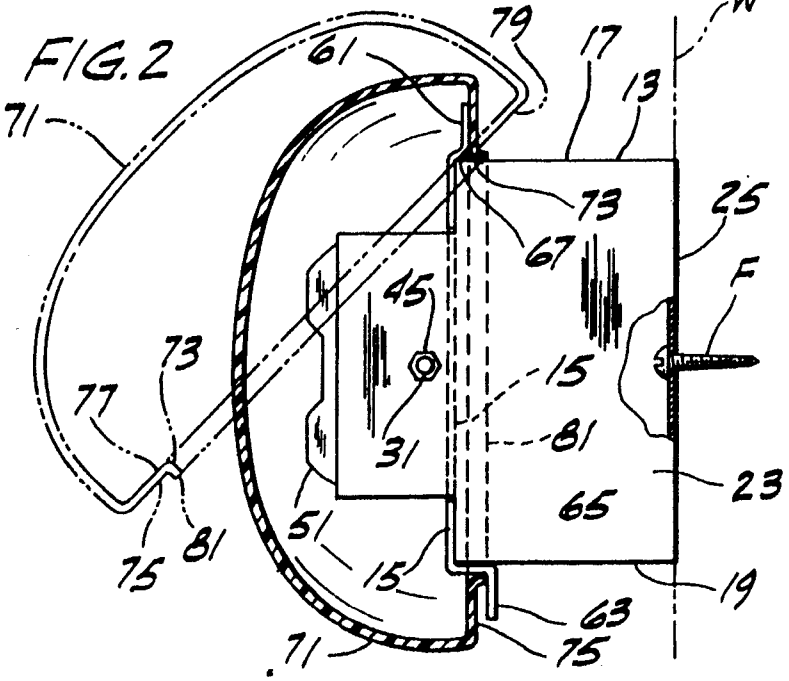
FIG. 2 is an enlarged right end view of the light fixture shown in FIG. 1, a diffuser of the fixture being shown in cross section.

Referring now to the drawings, a light fixture of this invention is generally indicated at 11. FIGS. 1–3 show the light fixture mounted in a horizontal position on a vertical wall W and FIGS. 4–8 show the light fixture mounted in a vertical position on a vertical wall W. The fixture 11 includes an elongate, generally rectangular housing 13 which, when disposed horizontally, has a front (first) generally vertical wall formed by a reflector plate 15, a top (second) generally vertical wall 17, a bottom (third) wall 19, two opposed end (on side) walls 21, 23 and a rear wall 25 which combine to form a generally box-shaped structure. The housing 13 may be made from sheet metal in which the top 17, bottom 19 and end walls 21, 23 are integral with the rear wall 25. The rear wall 25 is bent at opposite ends to form end walls 21, 23, and at its and bottom to form the top and bottom walls 17, 19, respectively. The fixture 11 may be mounted on the wall W (FIG. 2) by screw fasteners F through spaced-apart openings O provided in the rear wall 25.

Both end walls 21, 23 project forward beyond the plane of the front wall 15 and have clearance openings 27, 29 therein for receiving the shanks of fastening screws, such as machine screws 31. The openings 27, 29 are positioned generally centrally within the end walls forward of the plane of the front wall 15. The front wall 15 has two tabs 37, 39 projecting forwardly from opposite ends thereof with one tab 37 generally adjacent end wall 21 and the other tab 39 generally adjacent the other end wall 23. Each tab 37, 39 has a clearance slot 41, 43 formed therein and, like openings 27, 29, the slots 41, 43 are adapted to receive the shanks of the fastening screws 31.

The front wall 15 is fastened at each of its ends between the end walls 21, 23 to close the front of the housing 13. When the front wall is in this position, each slot 41, 43 of tabs 37, 39 is in registry with a respective opening 27, 29 in end walls 21, 23. Means mounting two fluorescent lamps L, as will be described in greater detail below, is disposed between the tabs 37, 39 and their respective end walls 21, 23 and is captured therebetween when the front wall 15 is in place on the housing 13. A fastener 31 and a nut fastener 45 secure one tab 37 of the front wall 15 to the end wall 21 of the housing, and another fastener 31 and nut fastener 45 secure the other tab 39 of the front wall to the end wall 23 of the housing.

Two socket members 49, 51 ("mounting means") are provided for mounting two lamps L on the housing 13 forward of the front wall 15 of the housing. Socket member 49 is disposed between tab 37 and end wall 21 and socket member 51 is disposed between tab 39 and end wall 23. More specifically, socket member 49 is fastened between end wall 21 and tab 37 by the screw 31 extending through an opening (not shown) formed in the socket member 49 in registry with opening 27 in the end wall 21 and slot 41 in the tab 37. Likewise, socket member 51 is fastened between end wall 23 and tab 39 by screw 31 extending through an opening (not shown) formed in the socket member 51 in registry with opening 29 in the end wall 23 and slot 43 in the tab 39. Each socket member 49, 51 has upper and lower sockets S, the upper sockets of the two socket members being adapted to mount one fluorescent lamp L and the lower sockets of the two socket members being adapted to mount another fluorescent lamp. It is to be understood that socket members 49, 51 may be constructed for receiving any number of fluorescent lamps L.

As shown in FIGS. 1–3, illustrating fixture 11 in a horizontal position (first orientation), the front wall 15 of the housing 13 has an upright lip 61 projecting up above the top wall 17. The lip 61 is integral with and extends along the entire length of the front wall 15 such that it forms an upper extension of the front wall. The front wall 15 also has a downwardly projecting flange 63 projecting below the bottom wall 19 of the housing 13 (when the fixture is mounted in a horizontal position). As with the lip 61, the flange 63 is integral with and extends along the entire length of the front wall 15 and forms a lower extension of the front wall. As shown in FIG. 2, the flange 63 lies in a plane generally parallel to and offset rearwardly from the vertical plane of the remainder of the front wall 15 and the vertical plane of lip 61. The flange 63 is connected to the front wall 15 by an integral shoulder 65 generally abutting the bottom wall 19 of the housing (see FIG. 2). The front wall 15 is also formed with a smaller shoulder 67 adjacent the lip 61 generally abutting the top wall 17 of the housing. Shoulders 65 and 67 ensure that the front wall 15 mounts securely on the housing 13.

The fixture 71 also includes a light diffuser 71, comprising a hollow shell defining an interior space for the lamps L. The shell 71 has a back formed by a continuous annular lip 75 which surrounds with a generally rectangular opening 73 in the shell for entry of the socket members 49, 51 and lamps L into the shell when the diffuser 71 is installed on the housing. As shown in FIGS. 1 and 2, the opening 73 lies in a generally vertical plane, vertical dimension of the opening 73 being slightly larger than the distance between the two shoulders 65, 67 in the front wall of the housing, and the horizontal dimension of the opening being slightly greater than the distance between the end walls 21, 23 of the housing 13, so that the front of the housing (including the portions of the end walls 21, 23 projecting forward beyond the front wall) may enter the opening. The light diffuser 71 is preferably a one-piece molded member formed from a semi-transparent material such as plastic. The lip 75 has an interior surface 77 and an exterior surface 79 as shown in FIG. 2. The lip is integral with the body of the shell of the diffuser 71 and extends entirely around the periphery of the opening 73. The edge of the lip 75 defining opening 73 is turned to extend rearwardly away from the diffuser, thereby forming a relatively narrow peripheral flange or rim 81 shown best in FIG. 2. As shown in FIG. 2, the diffuser is generally bulbous-shaped in transverse cross-section. However, it is to be understood that the diffuser may have any shape so long as it encloses the lamps.

Figure 9:
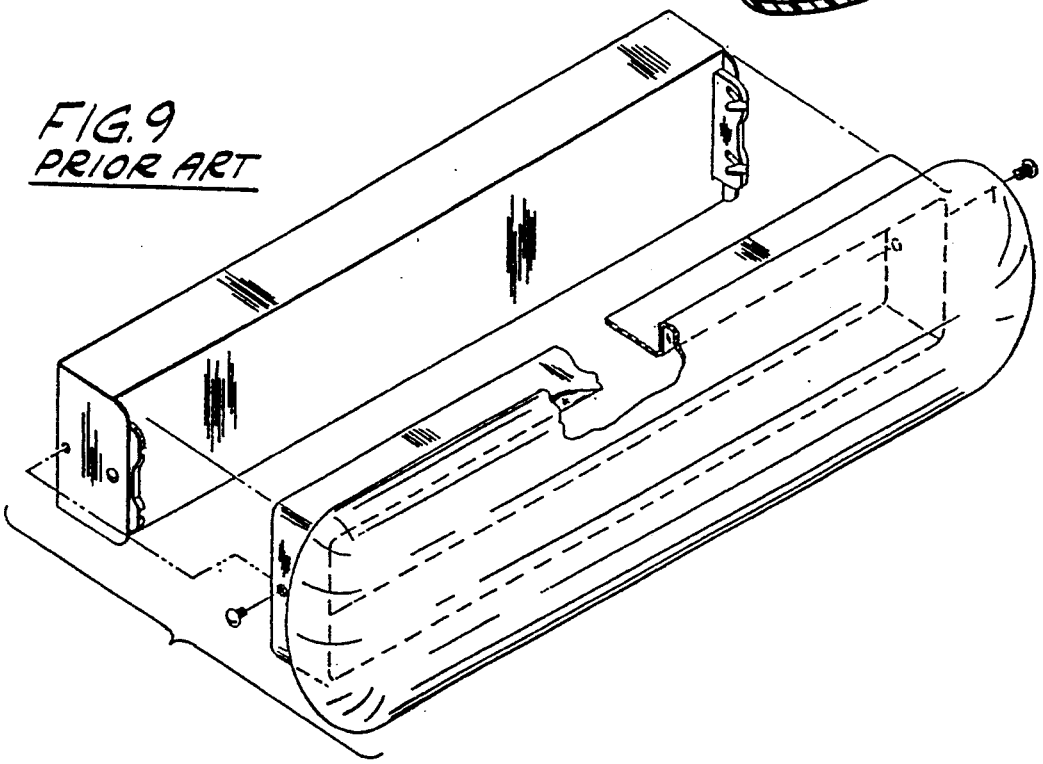
FIG.9 PRIOR ART
FIG. 9 is an exploded perspective view of a prior art light fixture.

When the diffuser 71 is installed on the housing 13 (FIG. 2), the housing lip 61 extends up on the inside of the shell closely adjacent upper portion of the back of the diffuser forming the interior surface 77 of the top edge margin of the diffuser lip 75 above the opening 73. The housing lip 61 and the interior surface 77 of the diffuser lip 75 are interengagable to hold the diffuser 71 on the housing 13, without the need for mechanical fasteners, such as the nut and bolt arrangement of the prior art light fixture of FIG. 9. In this position, the diffuser shell is suspended on the housing 13 with the upper portion of the rim 81 of the lip 75 bearing against the top wall 17 of the housing and with the lower portion of the rim 81 (i.e., a lower portion of the back of the diffuser shell) abutting against the flange 63 of the housing 13. The bottom flange 63 functions to prevent substantial rearward movement of the diffuser so that the diffuser does not engage the lamps. As best shown in FIGS. 1 and 2, the relatively short side portions of rim 81 (i.e., the sides of the rim adjacent end walls 21, 23) are engagable with the end walls 21, 23 to prevent the side-to-side movement of the diffuser 71 relative to the housing 13.

The center of gravity of the diffuser 71 when mounted on the housing 13 is such that the rim 81 of the diffuser is gravity biased against the bottom flange 63 of the housing for a tight (loose seal) fit of the diffuser on the housing 13. The bias of the diffuser 71 against the housing 13 provides a nice, neat appearance in addition to its functional advantages (e.g., holding the diffuser fixed relative to the housing 1).

FIGS. 4–8 illustrate the fixture 11 mounted in a vertical position (second orientation). When vertically mounted, a second lip 83 projects above end wall 21 (now the top end wall) adjacent the front wall 15 of the housing. In the embodiment shown, lip 83 is formed by one leg of a removable L-shaped bracket 85 mounted on end wall 21 by a screw fastener 31. However, it is to be understood that the fixture 11 may be oriented so that the other end wall 23 is at the top of the fixture 11 rather than end wall 21, in which case the bracket 85 (or other device forming second lip 83) would be mounted on end wall 23.

Figure 8:
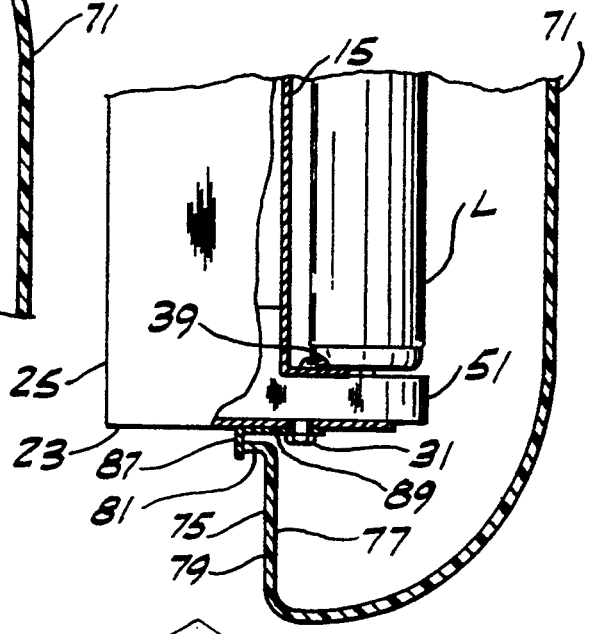
FIG. 8 is an enlarged cross-sectional view taken along lines 8—8 of FIG. 4.

For mounting the fixture 11 in a vertical position, the housing 13 further includes a second downwardly projecting flange 87 which projects below the other end wall (end wall 23 as shown in FIGS. 6 and 8) adjacent the front wall 15. Like housing lip 83, flange 87 is formed by one leg of an L-shaped bracket 89 mounted on the end wall 23 by a screw fastener 31. The second flange 87 performs substantially the same function as the first flange 63, that is, the rim 81 of the diffuser lip 75 abuts flange 87 to prevent the substantial rearward movement of the diffuser 71 relative the housing, thereby protecting the fluorescent lamps L (see FIG. 8).

Figure 1A:
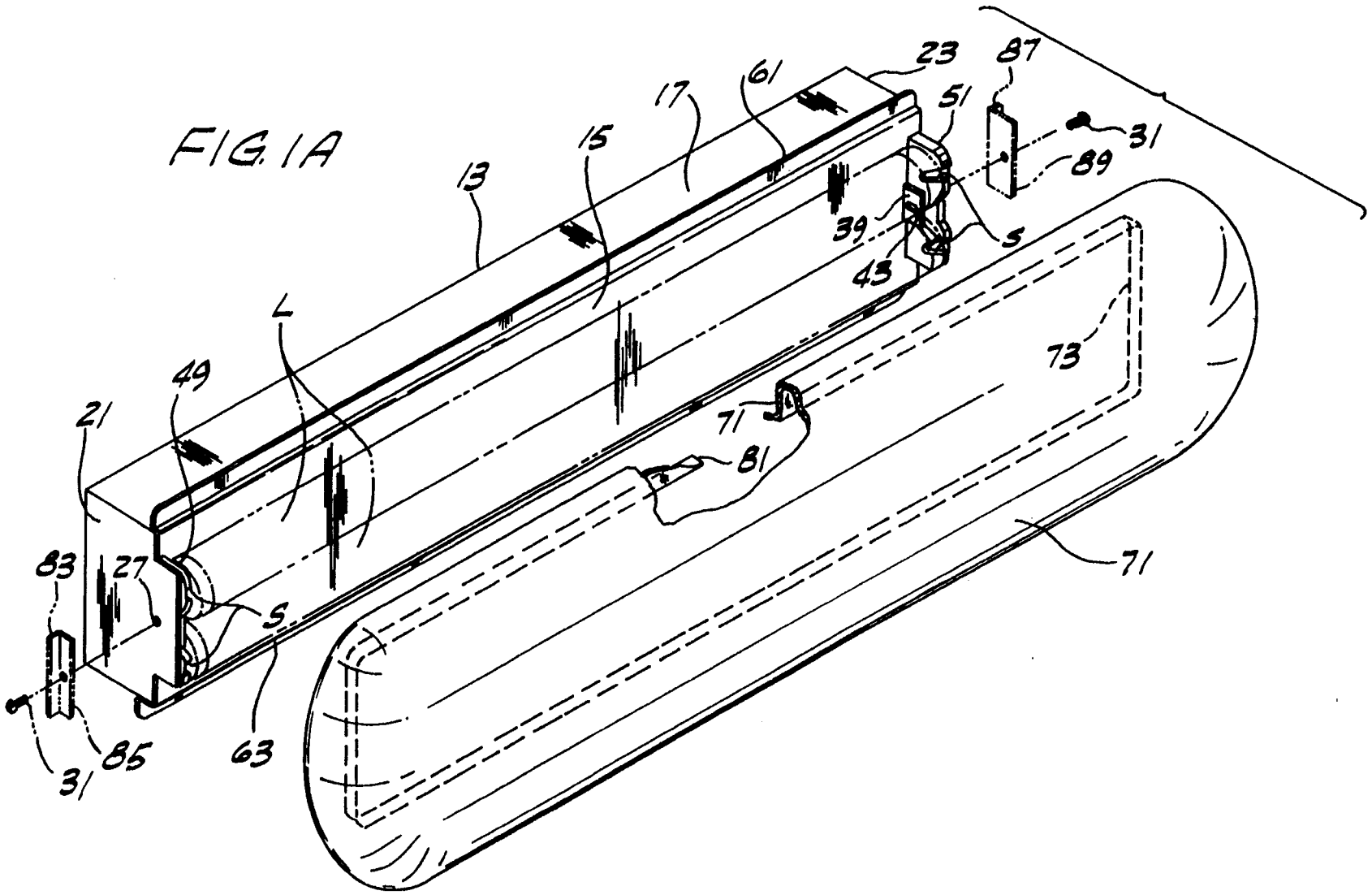
FIG. 1A is an exploded perspective of the light fixture shown in FIG. 1.

FIG. 1A illustrates that brackets 85 and 89 are pieces separate from the housing 13 and do not need to be attached to the housing when installing the fixture horizontally. However, it is to be understood that the brackets 85 and 89 may be attached to the housing when the fixture is horizontally mounted on a wall and not interfere with the installation of the diffuser 71 on the housing.

Figure 7:
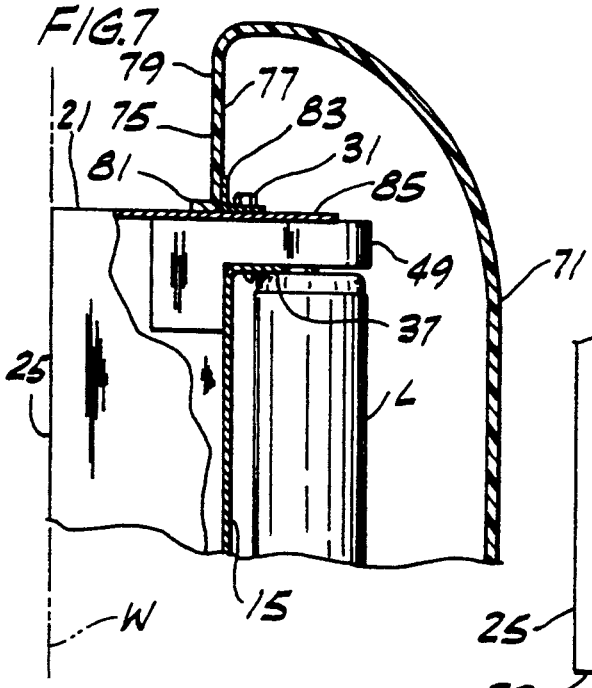
FIG. 7 is an enlarged cross-sectional view taken along lines 7—7 of FIG. 4.

When the fixture is mounted vertically, the diffuser 71 is placed on the housing so that the lip 83 extends up on the inside of the diffuser shell closely adjacent the interior surface 77 of the diffuser lip 75 above the diffuser opening 73 (FIG. 7). This lip 83 engages the interior surface 77 of the diffuser lip 75 to hold the diffuser 71 on the housing 13, without the need for mechanical fasteners. The diffuser 71 is suspended on the housing 13 with the upper portion of the rim 81 of the lip 75 bearing against the end wall 21 of the housing (see FIG. 7) and with the lower portion of the rim 81 abutting against the flange 87 (see FIG. 8). In this position, the housing lip 61 also engages the interior surface 77 of the diffuser lip 75 to assist in retaining the diffuser 71 on the housing 13 (FIG. 6). The longitudinal sides of the diffuser lip 75 are engageable with wall 17 and shoulder 65 ho prevent the side-to-side movement of the diffuser 71 relative to the housing 13.

In use, the housing 13 of light fixture 11 may be mounted on a wall in either a horizontal position or a vertical position by screw fasteners through openings O in the rear wall 25 of the housing. When mounted horizontally, diffuser 71 is installed on the housing by slipping the interior surface 77 of the upper portion of the diffuser lip 75 over the housing lip 61 and by pivoting (swinging) the remainder of the diffuser downwardly from the position shown in phantom in FIG. 2 to the position shown in solid lines wherein the fluorescent lamps L and the front of the housing are received inside the diffuser shell. In this position, the rim 81 of the diffuser lip 75 abuts the flange 63 of the housing to completely enclose the fluorescent lamps L. To change a burned-out lamp L, for example, the diffuser 71 may be pivoted (swung) upwardly about the lip 61 of the housing 13 until the fluorescent lamps and the socket members 49, 51 are outside opening 73 of the diffuser. The diffuser may then be moved generally upwardly (and slightly rearwardly) to disengage the diffuser lip 71 from the housing lip 61. At this point, the diffuser 71 may be completely removed from the housing 13, and the burned-out lamp replaced.

When mounted vertically, diffuser 71 is most easily installed on the housing 13 by slipping the interior surface 77 of the elongate side portion of the diffuser lip 75 over the first housing lip 61 and by raising the diffuser upwardly such that the shorter side portion of the diffuser lip 75 slips over the second housing lip 83. The remainder of the diffuser is then generally pivoted about the first housing lip 61 to a position in which the fluorescent lamps L and the front of the housing are received inside the diffuser shell. In this position, the rim 81 of the diffuser lip 75 abuts the flanges 63 and 87 of the housing to completely enclose the fluorescent lamps L. To remove the diffuser 71 from the housing 13, the diffuser is moved upwardly to disengage the diffuser lip 75 from the second housing lip 83 and then pivoted about the first housing lip 61 of the housing 13 until the fluorescent lamps and the socket members 49, 51 are outside opening 73 of the diffuser. The diffuser may then be moved generally to the left as shown in FIG. 4 to disengage the diffuser lip 71 from the housing lip 61. At this point, the diffuser 71 may be completely removed from the housing 13.

Significantly, the above process allows a person to easily install a fixture and replace a burned-out lamp by enabling the person to install or remove the diffuser without the aid of tools. As a result, a time-consuming step is eliminated thereby making the installation of the fixture and the replacement of lamps more efficient and less costly.

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. A light fixture comprising a housing, fasteners for mounting the housing in a first orientation on a vertical wall, said housing, as mounted in said first orientation, having a first wall constituting a generally vertical front wall and a second wall constituting a generally horizontal top wall extending rearwardly from the front wall, a lip on the housing adapted to project up above the top wall of the housing generally adjacent the front wall of the housing when the housing is mounted in said first orientation, means for mounting at least one lamp on the housing forward of the front wall of the housing, and a light diffuser comprising a hollow shell defining an interior space, said shell having a back with an opening therein to permit entry of said lamp and said lip on the housing into the interior space of the shell, the arrangement being such that when the housing is mounted in said first orientation, the diffuser may be installed on the housing in an installed position wherein (1) the opening in the back of the diffuser shell lies in a generally vertical plane, (2) an upper portion of the back of the diffuser shell above said opening bears on the top wall of the housing to support the diffuser on the housing, and (3) said lip on the housing extends up in the interior space of the shell closely adjacent an interior surface of the back of the shell above said opening in the back of the shell, said lip and interior surface of the shell being engageable to hold the diffuser on the housing, without the need for mechanical fasteners, in said installed position in which the back of the diffuser shell is in close, generally abutting relation with the front, generally vertical wall of the housing.

2. A light fixture as set forth in claim 1 wherein said lip comprises an upper extension of the front wall of the housing.

3. A light fixture as set forth in claim 1 wherein said housing is elongate and extends generally horizontally when mounted by said fasteners on a vertical wall in said first orientation.

4. A light fixture as set forth in claim 3 wherein the diffuser shell is a one-piece molded member.

5. A light fixture as set forth in claim 4 wherein said housing is also adapted to be mounted on a vertical wall in a second orientation in which said elongate housing extends generally vertically and in which said second wall of the housing constitutes a front wall of the housing.

6. A light fixture as set forth in claim 5 wherein said housing has a second lip which projects up above the housing adjacent the front wall of the housing when the housing is mounted in said second orientation, the second lip being adapted to extend up in said interior space of the diffuser shell when the shell is mounted on the housing, said second lip being engageable with an interior surface of the back of the diffuser shell to hold the diffuser on the housing, without the need for mechanical fastener, in a position in which the opening in the back of the diffuser shell is in a generally vertical plane, and in which the back of the diffuser shell is in close, generally abutting relation with the front, generally vertical wall of the housing.

7. A light fixture as set forth in claim 1 wherein said housing includes a third wall constituting a bottom wall when the housing is mounted in said first orientation, and a flange which projects below the bottom wall adjacent the front wall of the housing when the housing is mounted in said first orientation, the open back of said diffuser shell having a lower portion adapted to abut said flange when said diffuser is installed on the housing.

8. A light fixture as set forth in claim 7 wherein said flange comprises a lower extension of the front wail of the housing.

9. A light fixture as set forth in claim 8 wherein said flange lies in a vertical plane generally parallel to and offset rearwardly from a vertical plane containing said lip.

10. An elongate light fixture capable of being selectively mounted on a vertical wall in either a vertical position or a horizontal position, said fixture comprising an elongate generally rectangular housing having a front wall, fasteners for mounting said housing on said vertical wall in either a vertical position or a horizontal positions, means for mounting at least one lamp on the housing forward of the front wall of the housing, a light diffuser comprising a hollow shell defining an interior space, said shell having a back with an opening therein for entry of said lamp into said interior space of the shell as the diffuser is installed on the housing, a first lip which projects up above the housing adjacent the front wall of the housing when the housing is mounted in said horizontal position, said first lip being adapted to extend up in said interior space of the diffuser shell closely adjacent an interior surface of the back of the diffuser shell above said diffuser opening when the diffuser is installed on the housing and the housing is mounted in said horizontal position, said first lip and interior surface of the back of the diffuser shell being engageable to hold the diffuser on the housing, without the need for mechanical fasteners, in an installed position in which the diffuser shell is suspended on the housing with the opening in the back of the diffuser shell lying in a generally vertical plane, and with the back of the diffuser shell in close, generally abutting relation with the front wall of the housing, and a second lip which projects up above the housing adjacent the front wall of the housing when said housing is mounted in said vertical position, the second lip being adapted to extend up in said interior space of the diffuser shell closely adjacent an interior surface of the back of the diffuser shell above said diffuser opening when the diffuser is installed on the housing and the housing is mounted in said vertical position, said second lip and said interior surface of the back of the diffuser shell being engageable to hold the diffuser on the housing, without the need for mechanical fasteners, in an installed position in which the diffuser shell is suspended on the housing with the opening in the back of the diffuser shell lying in a generally vertical plane, and with the back of the diffuser shell in close, generally abutting relation with the front wall of the housing.

11. A light fixture as set forth in claim 10 wherein said first lip comprises an upper extension of the front wail of the housing when the fixture is mounted in a horizontal position.

12. A light fixture as set forth in claim 10 wherein the diffuser shell is a one-piece molded member.

13. A light fixture as set forth in claim 10 wherein said housing includes a first flange which projects below a bottom wall of the housing adjacent the front wall of the housing when said fixture is mounted in said generally horizontal position, the open back of said diffuser having a lower portion adapted to abut said first flange when said diffuser is installed on the housing in said generally horizontal position.

14. A light fixture as set forth in claim 13 wherein the first flange comprises an extension of the front wall of the housing.

15. A light fixture as set forth in claim 14 wherein the first flange lies in a vertical plane generally parallel to and offset rearwardly from a vertical plane containing said first lip.

16. A light fixture as set forth in claim 15 wherein said housing includes a second flange which projects below a bottom wall of the housing adjacent the front wall of the housing when said fixture is mounted in said generally vertical position, the open back of said diffuser having a lower portion adapted to abut said second flange when said diffuser is installed on the housing in said generally vertical position.

17. A light fixture as set forth in claim 16 wherein the second flange lies in a vertical plane generally parallel to and offset rearwardly from a vertical plane containing said second lip.

18. A light fixture comprising a housing, at least one fastener for mounting said housing on a vertical wall, said housing as mounted on said vertical wall having a top wall, a bottom wall, opposite side walls, and a generally vertical front wall, a lip projecting above the top wall of the housing generally adjacent the front wall of the housing, means for mounting at least one lamp on the housing forward of the front wall of the housing, and a light diffuser comprising a hollow shell defining an interior space, said shell having a back with an opening therein to permit entry of said lamp into the shell as the diffuser is installed on the housing, the arrangement being such that the diffuser is adapted to be mounted on the housing with the shell of the diffuser supported by the top wall of the housing and the lip of the housing extending up in said interior space of the shell closely adjacent an upper portion of the back of the diffuser shell above said opening in the diffuser shell, the lip of the housing and the back of the diffuser shell above said opening being engageable to hold the diffuser on the housing, without the need for mechanical fasteners, in an installed position in which the diffuser shell is suspended on the housing with the opening in the back of the diffuser shell lying in a generally vertical plane, and with the back of the diffuser shell generally abutting the generally vertical front wall of the housing adjacent the sides and bottom walls of the housing.

19. A light fixture as set forth in claim 1 wherein said diffuser shell has a center of gravity such that when it is installed on the housing, the diffuser shell is gravity biased to swing down toward said installed position in which the back of the diffuser shell is in said close, generally abutting relation with the front wall of the housing.

20. A light fixture to set forth in claim 10 wherein said diffuser shell has a center of gravity such that when it is installed on the housing, the diffuser shell is gravity biased to swing down toward said installed position in which the back of the diffuser shell is in said close, generally abutting relation with the front wall of the housing.

21. A light fixture as set forth in claim 18 wherein said diffuser shell has a center of gravity such that when it is installed on the housing, the diffuser shell is gravity biased to swing down toward said installed position in which the back of the diffuser shell is in said close, generally abutting relation with the front wall of the housing.

* * * * *

UNITED STATES PATENT AND TRADEMARK OFFICE

CERTIFICATE OF CORRECTION

PATENT NO. : 5,381,320

DATED : January 10, 1995

INVENTOR(S) : Randy L. Jordon

It is certified that error appears in the above-indentified patent and that said Letters Patent is hereby corrected as shown below:

Column 7, claim 8, line 55, "front wail" should read ---front wall---.

Column 7, claim 10, lines 67-68, "horizontal positions" should read ---horizontal position---.

Column 8, claim 11, line 45, "front wail" should read ---front wall---.

Signed and Sealed this

Fourteenth Day of May, 1996

*Attest:*

Bruce Lehman

BRUCE LEHMAN

*Attesting Officer*

*Commissioner of Patents and Trademarks*